US009616298B1

(12) United States Patent
Barksdale et al.

(10) Patent No.: US 9,616,298 B1
(45) Date of Patent: Apr. 11, 2017

(54) GOLF CLUB WITH IMPROVED WEIGHTING

(71) Applicant: Acushnet Company, Fairhaven, MA (US)

(72) Inventors: Dustin A. Barksdale, San Marcos, CA (US); Donald S. Bone, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/864,008

(22) Filed: Sep. 24, 2015

(51) Int. Cl.

| | |
|---|---|
| ***A63B 53/12*** | (2015.01) |
| ***A63B 53/14*** | (2015.01) |
| ***A63B 53/00*** | (2015.01) |
| ***A63B 53/10*** | (2015.01) |
| *A63B 53/04* | (2015.01) |

(52) U.S. Cl.
CPC ..... *A63B 53/00* (2013.01); *A63B 53/10* (2013.01); *A63B 53/12* (2013.01); *A63B 2053/0491* (2013.01)

(58) Field of Classification Search
CPC ..... A63B 60/24; A63B 60/02; A63B 53/00; A63B 53/10; A63B 53/12; A63B 53/14
See application file for complete search history.

(56) References Cited

U.S. PATENT DOCUMENTS

| | | | |
|---|---|---|---|
| 1,167,387 | A | 1/1916 | Daniel |
| 1,831,255 | A | 11/1931 | Menzies |
| 2,051,083 | A | 8/1936 | Hart |
| 2,782,035 | A | 2/1957 | East |
| 2,992,828 | A | 7/1961 | Stewart |
| 3,075,768 | A | 1/1963 | Karns |
| 3,270,564 | A | 9/1966 | Evans |
| 3,606,327 | A | 9/1971 | Gorman |
| 3,792,863 | A | 2/1974 | Evans |
| 3,945,646 | A | 3/1976 | Hammond |
| 3,963,236 | A | 6/1976 | Mann |
| 3,979,122 | A | 9/1976 | Belmont |
| 4,461,479 | A | 7/1984 | Mitchell |
| 4,674,746 | A | 6/1987 | Benoit |
| 4,690,407 | A | 9/1987 | Reisner |
| 4,887,815 | A | 12/1989 | Hughes et al. |
| 4,936,586 | A | 6/1990 | Van Raemdonck |
| 4,988,102 | A | 1/1991 | Reisner |
| 5,049,422 | A | 9/1991 | Honma |

(Continued)

FOREIGN PATENT DOCUMENTS

| | | | |
|---|---|---|---|
| JP | 2012-016560 | A | 1/2012 |

OTHER PUBLICATIONS http://www.aerotechgolfshafts.com/playerssami99_spec_iron.php (Feb. 24, 2015).

(Continued)

*Primary Examiner* — John E Simms, Jr.
(74) *Attorney, Agent, or Firm* — Randy K. Chang

(57) ABSTRACT

A golf club with improved weighting characteristic is disclosed. More specifically, the present invention discloses to a golf club wherein the improved weighting distribution stems from an increase in the mass of the golf club at a specific distance away from the butt end or proximal end of the golf club head to help increase the feel and minimize the dispersion of the golf shot by minimizing the pull and or draw tendencies of a golf shot.

11 Claims, 7 Drawing Sheets

(56) References Cited

U.S. PATENT DOCUMENTS 5,152,527 A 10/1992 Mather et al.
5,244,209 A 9/1993 Benzel
5,297,791 A * 3/1994 Negishi ..... A63B 53/10 473/316
5,351,952 A 10/1994 Hackman
5,465,967 A 11/1995 Boeckenhaupt
5,474,298 A 12/1995 Lindsay
5,569,099 A 10/1996 Jackson
5,575,722 A 11/1996 Saia et al.
5,591,091 A 1/1997 Hackman
5,632,691 A * 5/1997 Hannon ..... A63B 53/007 473/292
5,638,300 A 6/1997 Johnson
5,711,721 A 1/1998 Johnson et al.
5,716,289 A 2/1998 Okoneski
5,792,000 A 8/1998 Weber et al.
5,803,823 A 9/1998 Gobush et al.
5,810,676 A 9/1998 Bird
5,823,878 A 10/1998 Welch
5,984,804 A 11/1999 Berg
6,007,431 A 12/1999 Bloom, Jr.
6,083,123 A 7/2000 Wood
6,302,802 B1 10/2001 Pao
6,364,787 B1 4/2002 Huiskamp
6,441,745 B1 8/2002 Gates
6,514,081 B1 2/2003 Mengoli
6,572,490 B2 6/2003 Ashida
6,626,768 B2 9/2003 Roelke
6,966,846 B2 11/2005 Bloom, Jr.
6,988,968 B2 1/2006 Okamoto
7,041,000 B1 * 5/2006 Galloway ..... A63B 69/3632 473/256
7,041,014 B2 5/2006 Wright et al.
7,154,100 B2 12/2006 Spartiotis et al.
7,171,027 B2 1/2007 Satoh
7,175,538 B2 2/2007 Miller
7,195,565 B2 3/2007 White et al.
7,219,033 B2 5/2007 Kolen
7,261,641 B2 8/2007 Lindner
7,264,554 B2 9/2007 Bentley
7,264,555 B2 9/2007 Lee et al.
7,267,619 B1 9/2007 Pettis
7,381,139 B2 6/2008 Weeks et al.
7,399,235 B2 7/2008 Gill et al.
7,399,236 B2 7/2008 Takeuchi
7,458,902 B2 12/2008 Gill
7,481,716 B1 1/2009 Johnson
7,500,921 B2 3/2009 Cheng
7,545,434 B2 6/2009 Bean et al.
7,635,310 B2 12/2009 Keough
7,686,701 B2 3/2010 Hasegawa
7,693,415 B2 4/2010 Shiohara
7,699,718 B2 4/2010 Lindner
7,704,157 B2 4/2010 Shirai et al.
7,704,160 B2 4/2010 Lindner
7,704,161 B2 4/2010 Lindner
7,744,480 B2 6/2010 Gobush
7,798,911 B2 9/2010 Gill
7,804,998 B2 9/2010 Mündermann et al.
7,870,790 B2 1/2011 Sato et al.
7,874,944 B2 1/2011 LoVine
7,887,440 B2 2/2011 Wright et al.
7,909,705 B2 3/2011 Gill et al.
7,997,997 B2 8/2011 Bennett et al.
8,118,687 B1 2/2012 Galloway
8,150,248 B1 4/2012 Woodman
8,177,658 B1 5/2012 Johnson
8,216,085 B2 7/2012 Fujimoto
8,221,257 B2 7/2012 Davenport
8,257,191 B2 9/2012 Stites et al.
8,313,392 B2 11/2012 White
8,335,669 B2 12/2012 Shimizu et al.
8,444,502 B2 5/2013 Karube
8,475,300 B2 7/2013 Ueda
8,491,408 B2 * 7/2013 Beach ..... A63B 53/10 473/296
8,556,267 B2 10/2013 Gobush
8,595,312 B2 11/2013 Daellenbach et al.
8,636,605 B2 1/2014 Rose
8,657,707 B2 2/2014 Ueda et al.
8,668,595 B2 3/2014 Boyd et al.
2002/0082105 A1 * 6/2002 Foresi ..... A63B 53/0487 473/251
2002/0173364 A1 11/2002 Boscha
2003/0109335 A1 6/2003 Dineen et al.
2004/0138000 A1 7/2004 Braly et al.
2005/0054459 A1 3/2005 Oldenburg
2006/0084516 A1 4/2006 Eyestone et al.
2006/0166737 A1 7/2006 Bentley
2010/0323810 A1 * 12/2010 Kaneko ..... A63B 53/10 473/320
2012/0052973 A1 3/2012 Bentley
2012/0100923 A1 4/2012 Davenport
2012/0157241 A1 6/2012 Nomura et al.
2012/0214606 A1 8/2012 Ueda
2012/0277016 A1 11/2012 Boyd et al.
2012/0277017 A1 11/2012 Boyd et al.
2012/0277018 A1 11/2012 Boyd et al.
2012/0286114 A1 11/2012 Jertson et al.
2012/0289354 A1 11/2012 Cottam et al.
2012/0302364 A1 * 11/2012 Boccieri ..... A63B 53/145 473/300
2013/0041590 A1 2/2013 Burich et al.
2013/0143687 A1 6/2013 Stafford
2013/0165249 A1 6/2013 Margoles et al.
2013/0324289 A1 12/2013 Matsunaga
2013/0344973 A1 12/2013 Margoles et al.

OTHER PUBLICATIONS http://www.golfwrx.com/281885/spotted-true-temper-dynamic-gold-amt-shaft/ (Feb. 17, 2015).

GoPro Hero HD Club Cam (http://www.youtube.com/watch?v=JBC3D2xOgHI), posted Mar. 8, 2011, 6 pages.

* cited by examiner

GOLF CLUB WITH IMPROVED WEIGHTING

FIELD OF THE INVENTION

The present invention relates generally to a golf club with improved weighting characteristics. More specifically, the present invention relates to a golf club wherein the improved weighting distribution stems from an increase in the mass of the golf club at a specific distance away from the butt end or proximal end of the golf club head to help increase the feel and minimize the dispersion of the golf shot by minimizing the push, fade, and slice tendencies of a golf shot.

BACKGROUND OF THE INVENTION

In order to create golf clubs that help the golfer achieve a better score, golf club designers have made numerous technological advancements in creating a golf club that is easier to hit. Technological advances such as metalwood drivers, cavity back irons, and even graphite shafts have all made the game of golf easier for the average golfers by helping them hit the golf ball longer and straighter. However, despite all the technical advancements in the game of golf, the biggest variation in a golf swing is often produced by the golfer himself or herself. In fact, a golf swing is so unique to each individual golfer; it can be argued that no two golfers have identical golf swings.

In order to address the often diverging needs of the different swings associated with different golfers, golf club designers make different models of golf clubs that have different performance characteristics to help golfers get more performance out of their particular golf swing. More specifically, golf club designers often create different models of golf club heads having different sizes, shapes, weight, and geometry, allowing various golfers to select from the model that suits their game the most. Although many believe the golf club head to be the most important component of a golf club, golf club designers cannot expect a golf club to perform well if they completely ignore other components of the golf club. One of these key components is the shaft of the golf club head, which can often have different weights, flexes, and materials to provide the golfer even more precision to help them further create the best golf club for their needs. In addition the shaft, the grip portion of the golf club head often forms another important component of the golf club itself. By adjusting the material, weight, feel, tactility of the grip portion of the golf club, the performance of the golf club can once again be significantly affected.

It can be seen from above that although there are several key components to a golf club, the weight of each of the components play a key role in adjusting the overall performance of the golf club itself. In one example, U.S. Pat. No. 3,979,122 to Belmont illustrates one of the way to improve the performance of a golf club head by adjusting the weight at the club head portion of the golf club head. In another example, U.S. Pat. No. 2,051,083 to Hart illustrates one of the earlier examples of adjusting the weight of the golf club head at the grip end of the golf club.

While the prior art has explored many different ways to adjust the weight of the golf club by focusing on the club head portion and the grip portion of the golf club, there has been relatively little advancements in the shaft technology, especially when compared to other components such as the club head. Moreover, there is even less advancement when it comes to focusing the weight adjustment on specific regions of the shaft. Hence it can be seen that there is a need for a technology that can help improve the overall performance of the golf club head by focusing on adjusting the weight of the golf club head at the shaft portion of the golf club.

BRIEF SUMMARY OF THE INVENTION

One aspect of the present invention is a golf club comprising a club head located at a distal end of the golf club, a grip located at a proximal end of the golf club, and a shaft juxtaposed between the club head and the grip, connecting the club head to the grip. The shaft further comprises a heavy weighted section, located at a distance of between exactly 10 and exactly 15 inches away from the proximal end of the golf club, and wherein the heavy weighted section has a mass of greater than about 9 grams.

In another aspect of the present invention is a golf club shaft comprising of a first lightweight section located at a proximal end of the golf shaft, wherein the first lightweight section is defined as a portion of the golf club shaft encompassing a distance of 0 inches to 5 inches from the proximal end of the shaft. The golf club shaft also comprises of a second lightweight section located adjacent to the first lightweight section, wherein the second lightweight section is defined as a portion of the golf club shaft encompassing a distance of 5 inches to 10 inches from the proximal end of the shaft. Finally, the golf club shaft also comprises of a heavy weighted section located adjacent to the second lightweight section, wherein the heavy weighted section is defined as a portion of the golf club shaft encompassing a distance of 10 inches to 15 inches from the proximal end of the shaft, wherein a mass of the heavy weighted section is greater than about 140% of a mass of the second lightweight section.

In a further aspect of the present invention, is a golf club comprising a club head located at a distal end of the golf club, a grip located at a proximal end of the golf club, and a shaft juxtaposed between the club head and the grip, connecting the club head to the grip. The shaft further comprises of a first lightweight section located at a proximal end of the golf shaft, wherein the first lightweight section is defined as a portion of the golf club shaft encompassing a distance of 0 inches to 5 inches from the proximal end of the shaft. The golf club shaft also comprises of a second lightweight section located adjacent to the first lightweight section, wherein the second lightweight section is defined as a portion of the golf club shaft encompassing a distance of 5 inches to 10 inches from the proximal end of the shaft. Finally, the golf club shaft also comprises of a heavy weighted section located adjacent to the second lightweight section, wherein the heavy weighted section is defined as a portion of the golf club shaft encompassing a distance of 10 inches to 15 inches from the proximal end of the shaft, wherein a mass of the heavy weighted section is greater than about 14% of a mass of the shaft.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
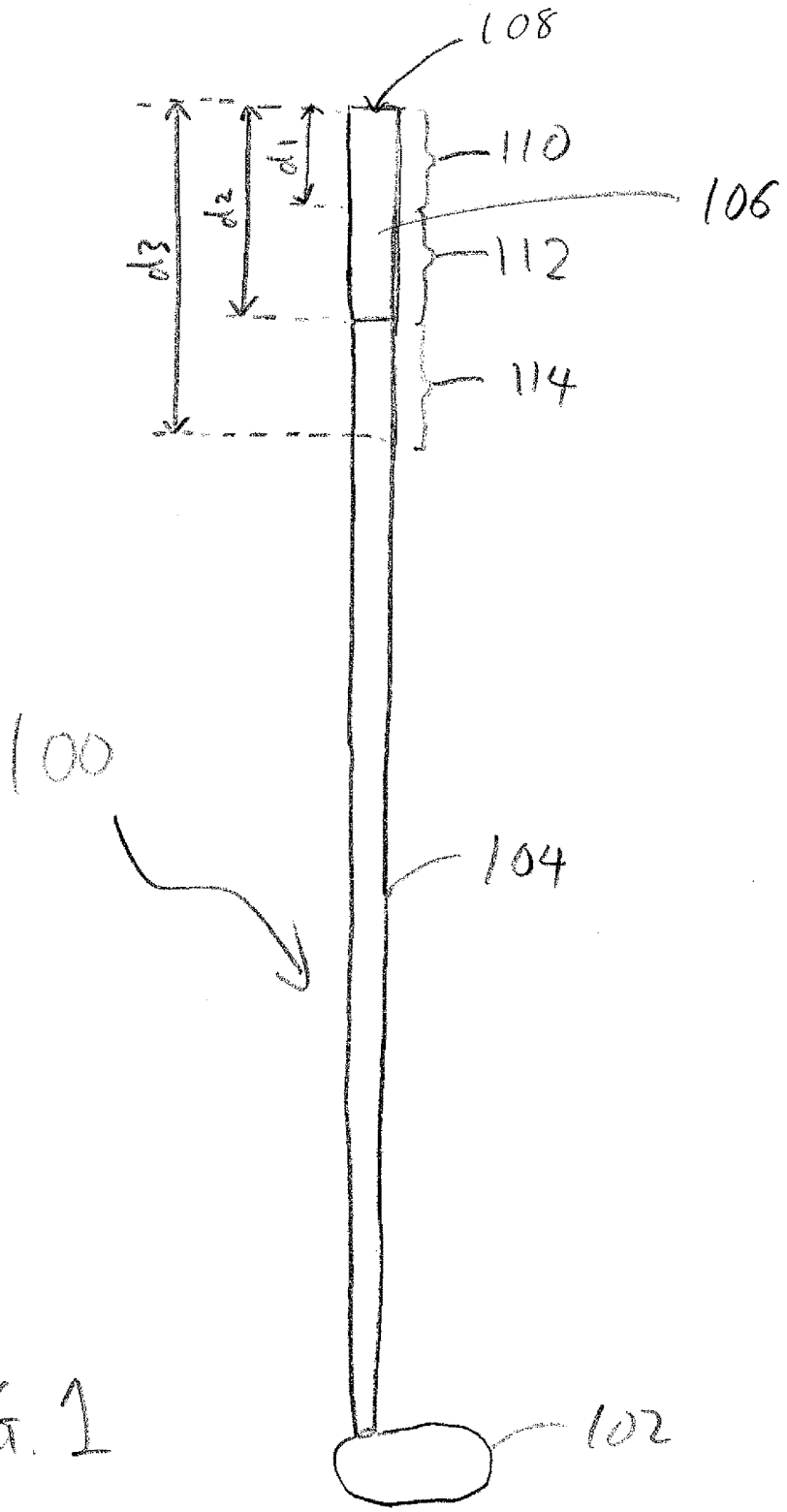
FIG. 1 shows a perspective view of a golf club in accordance with an exemplary embodiment of the present invention.

FIG. 1 of the accompanying drawings shows a perspective view of a golf club 100 in accordance with the present invention. The golf club 100 may generally include a club head 102 attached to a distal end of the golf club 100, a grip 106 attached to a proximal end 108 of the golf club 100, and a shaft juxtaposed between the club head 102 and the grip 106. Finally, and most importantly, it can be said that the golf club 100 may further comprise of heavy weighted section 114 located at a distance that is between d2 and d3 away from the butt end or proximal end 108 of the golf club 100. A detailed discussion regarding the benefits of having a heavy weighted section 114 at the location described can be found in U.S. patent application Ser. No. 14/214,025, the disclosure of which is incorporated by reference in its entirety.

In addition to the above, FIG. 1 also shows the different weighting portions at the butt end or proximal end 108 of the golf club 100. The first lightweight section 110 is located underneath the grip 106, and covers the distance d1 of 5 inches. The second lightweight section 112 may also generally located underneath the grip 106, and cover the second 5 inches of the butt end or proximal end 108 of the grip, thus distance d2 may be 10 inches. Finally, the heavy weighted section 114 may cover the third 5 inches of the butt end or proximal end 108 of the grip, thus distance d3 may be 15 inches. The heavy weighted section 114 may generally be where the golf club 100 incorporates a material with higher density into that section to help improve the performance of the golf club 100. In another way, it can be said that the current inventive golf club head has a heavy weighted section 114, located between 10 and 15 inches away from the butt end or proximal end 108 of the grip. To provide a more detailed illustration of the internal workings of the heavy weighted section 114, a cross-sectional view of the butt end or proximal end 108 of the golf club shaft 104 is provided in FIG. 2.

Figure 2:
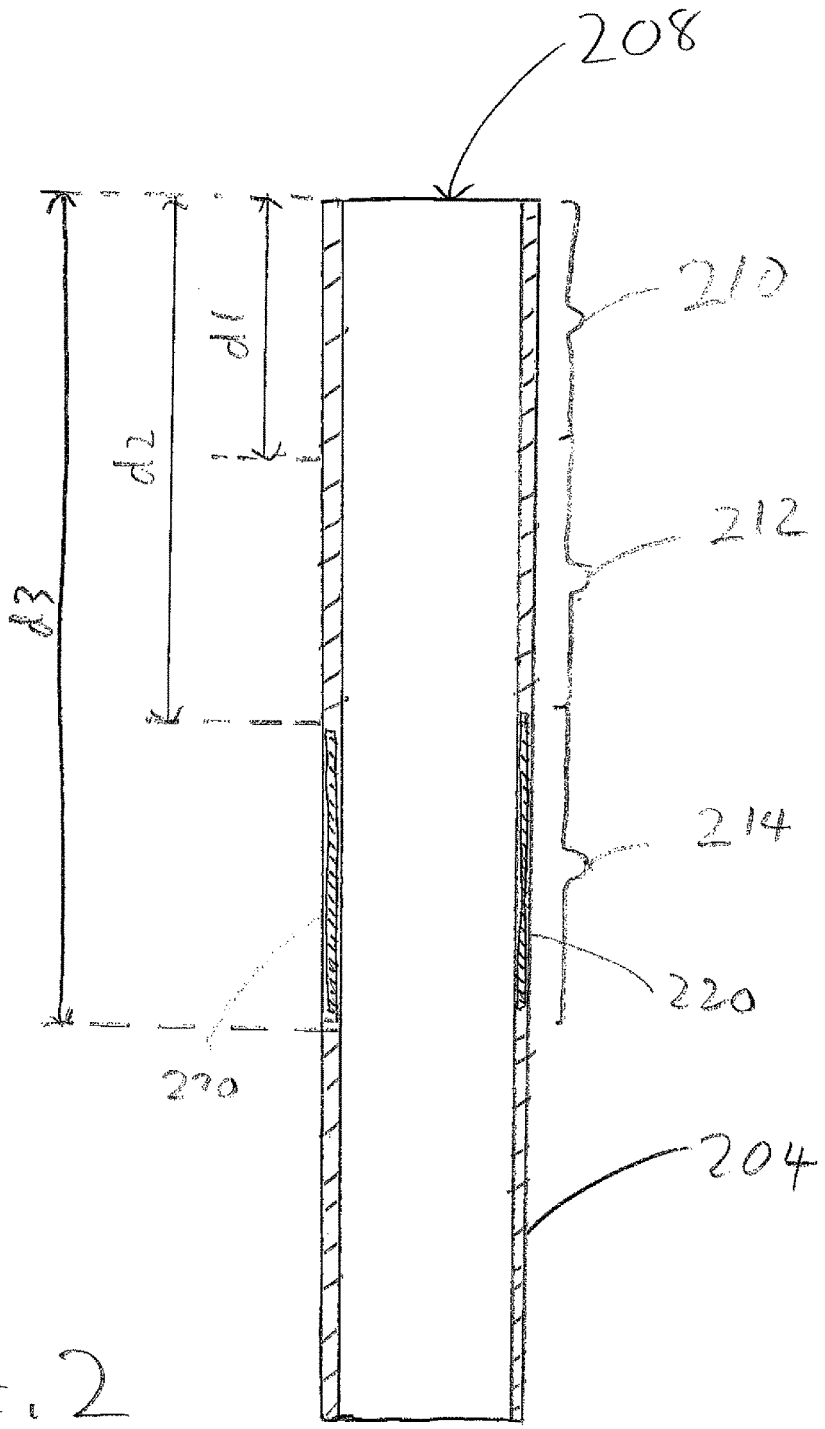
FIG. 2 shows an enlarged cross-sectional view of the butt end or proximal end of a golf club shaft in accordance with the exemplary embodiment of the present invention.

FIG. 2 provides a cross-sectional view of the butt end or proximal end 208 of a shaft 204 in accordance with a preferred embodiment of the present invention. First and foremost, it is worth noting that this view of the golf club head does not include the grip 206, and all subsequent weighting discussed will refer to the shaft 204 portion of the golf club 200 without the grip 206. In this exemplary embodiment of the present invention, the first lightweight section 210, defined as the first 5 inches of the shaft 204 as shown in d1, may generally have a total mass of less than about 7 grams. The second lightweight section 212, defined as the second 5 inches of the shaft 204 as defined by d2 minus d1, may generally also have a total mass of less than about 7 grams. Finally, and most importantly, the present invention has a heavy weighted section 214, defined as the third 5 inches of the shaft 204 as defined by d3 minus d2 and d1, may generally have a total mass of greater than about 9 grams, more preferably greater than about 9.5 grams, and most preferably greater than about 10.0 grams. Alternatively speaking, it can be said that the golf club may have a shaft 202 wherein the section located between 10 inches and 15 inches away from the butt end or proximal end 208 of the shaft 204 may have a mass of greater than about 9 grams, more preferably greater than about 9.5 grams, and most preferably greater than about 10 grams.

Although the above discussion focuses on the absolute mass of the heavy weighted section 214, it should be appreciated that the relative dramatic increase in the mass of the golf club shaft 204 at the heavy weighted section 214 compared to the second lightweight section 212 could be another good indicator of the performance enhancement of the present invention. Due to the fact that most carbon fiber golf clubs are constructed by rolling layers of composite on a mandrel, having a highly concentrated location for a heavy weighted section 214 when the neighboring portions have a relatively low mass is an important feature to identify. Hence, it can be understood that in addition to the mass articulated above, the heavy weighted section 214 may generally have a mass that is greater than about 140% than the mass of the second lightweight section 212, more preferably greater than about 145% than the mass of the second lightweight section 212, and most preferably greater than about 150% than the mass of the second lightweight section 212.

In an alternative embodiment of the present invention, the first lightweight section 210 and the second lightweight section 212 may be lumped together, creating a different ratio with the heavy weighted section 214. In this embodiment, the relationship between the heavy weight section 214 may have a mass that is greater than about 50% of the mass of the first lightweight section 210 and the second lightweight section 212, more preferably greater than about 55% of the mass of the first lightweight section 210 and the second lightweight section 212, and most preferably greater than about 60% of the mass of the first lightweight section 210 and the second lightweight section 212.

Finally, it is worth noting that in addition recognizing the extreme mass concentration of the golf club shaft 204 in the heavy weighted section 214, as well as the dramatic increase in mass from the second lightweight section 212 to the heavy weighted section 214; the ratio of the mass of the heavy weighted section 214 relative to the overall mass of the shaft 204 is also elevated. In the current exemplary embodiment of the present invention, the ratio of the mass of the heavy weighted section 214 divided by the overall mass of the shaft 204 may generally be greater than about 14%, more preferably greater than about 15%, and most preferably greater than about 17%. In this embodiment of the present invention, the cut weight of the shaft may generally be between about 45 grams to about 65 grams, more preferably between about 50 grams and about 60 grams, and most preferably about 55 grams.

In addition to illustrating the concentration of the mass of the shaft within the heavy weighted section 214 and its ratio relative to other portions of the golf club shaft 200, FIG. 2 of the accompanying drawing also illustrate one embodiment of the present invention wherein the weight concentration is achieved. In this embodiment of the present invention, a dense layer 220 is sandwiched within the different plies of the carbon fiber during the roll-up process to create the concentrated mass at the heavy weighted section 214. The current exemplary embodiment shows the dense layer 220 being located centrally between the internal and external walls of the shaft 200, however the dense layer 220 could be biased towards the internal wall or the external wall of the shaft 204 without departing from the scope and content of the present invention so long as it is capable of creating a heavy weighted section 214. In one exemplary embodiment of the present invention, the dense layer 220 may be a thin layer of tungsten metal, however numerous other materials such as steel, copper, lead, or any other suitable material with a higher density than the material of shaft 204 could be used to create the dense layer 220 without departing from the scope and content of the present invention.

Figure 3:
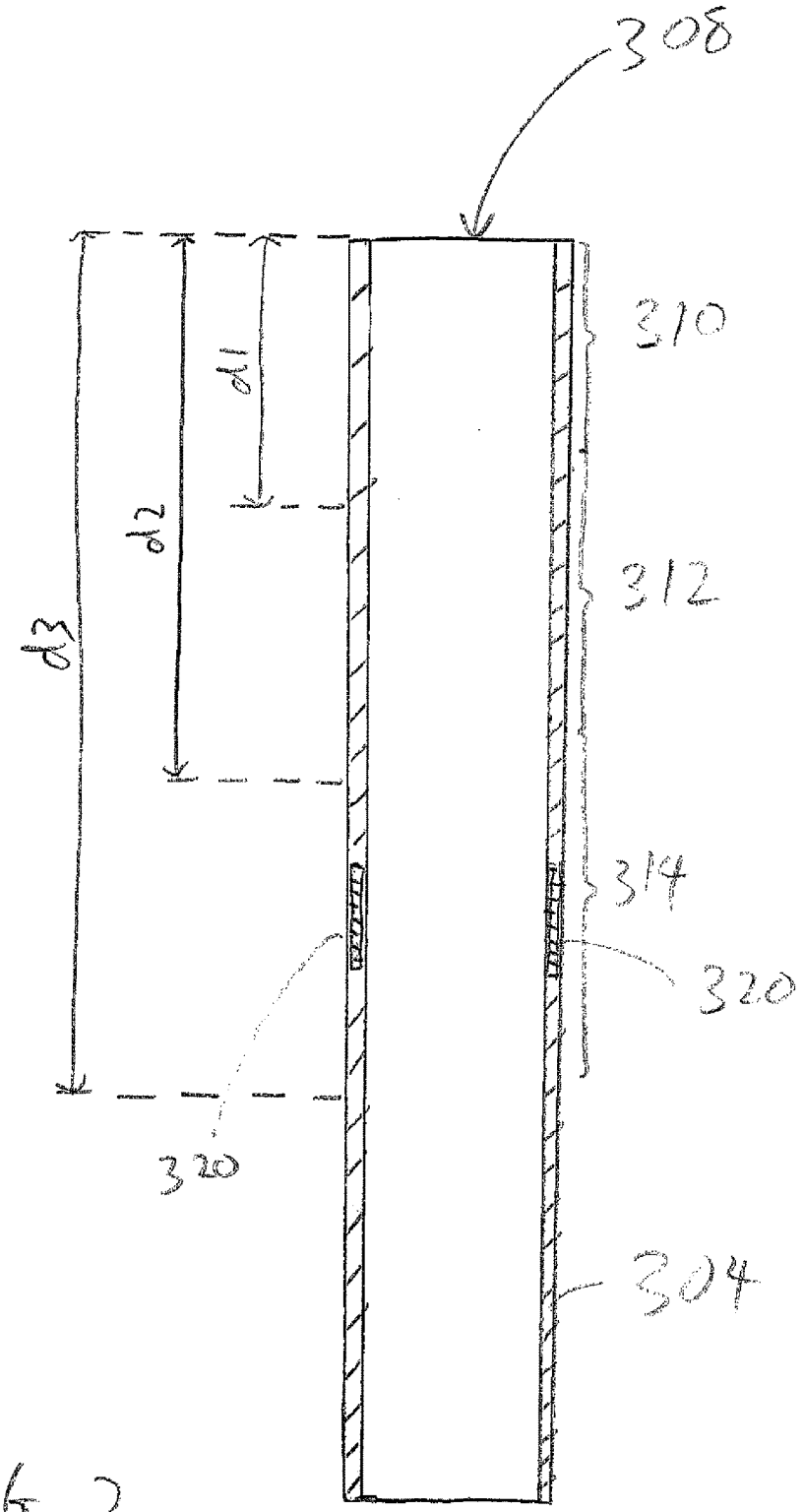
FIG. 3 shows an enlarged cross-sectional view of the butt end or proximal end of a golf club shaft in accordance with an alternative embodiment of the present invention.

FIG. 3 of the accompanying drawings shows a cross-sectional view of the butt end or proximal end 308 of a shaft 304 in accordance with an alternative embodiment of the present invention. This alternative embodiment of the present invention is very similar to the preferred embodiment of the present invention shown in FIG. 2. In this alternative embodiment of the present invention, it can be seen that the dense layer 320 may not cover the entire 5 inch section in of the heavy weighted section 314 to achieve the weighting objective stated above. Thus, even though the dense layer 320 may not span the entire length of the heavy weighted section 314, it may still cause the heavy weighted section to have an overall mass of greater than about 9 grams, more preferably greater than about 9.5 grams, and most preferably greater than about 10 grams.

Figure 4:
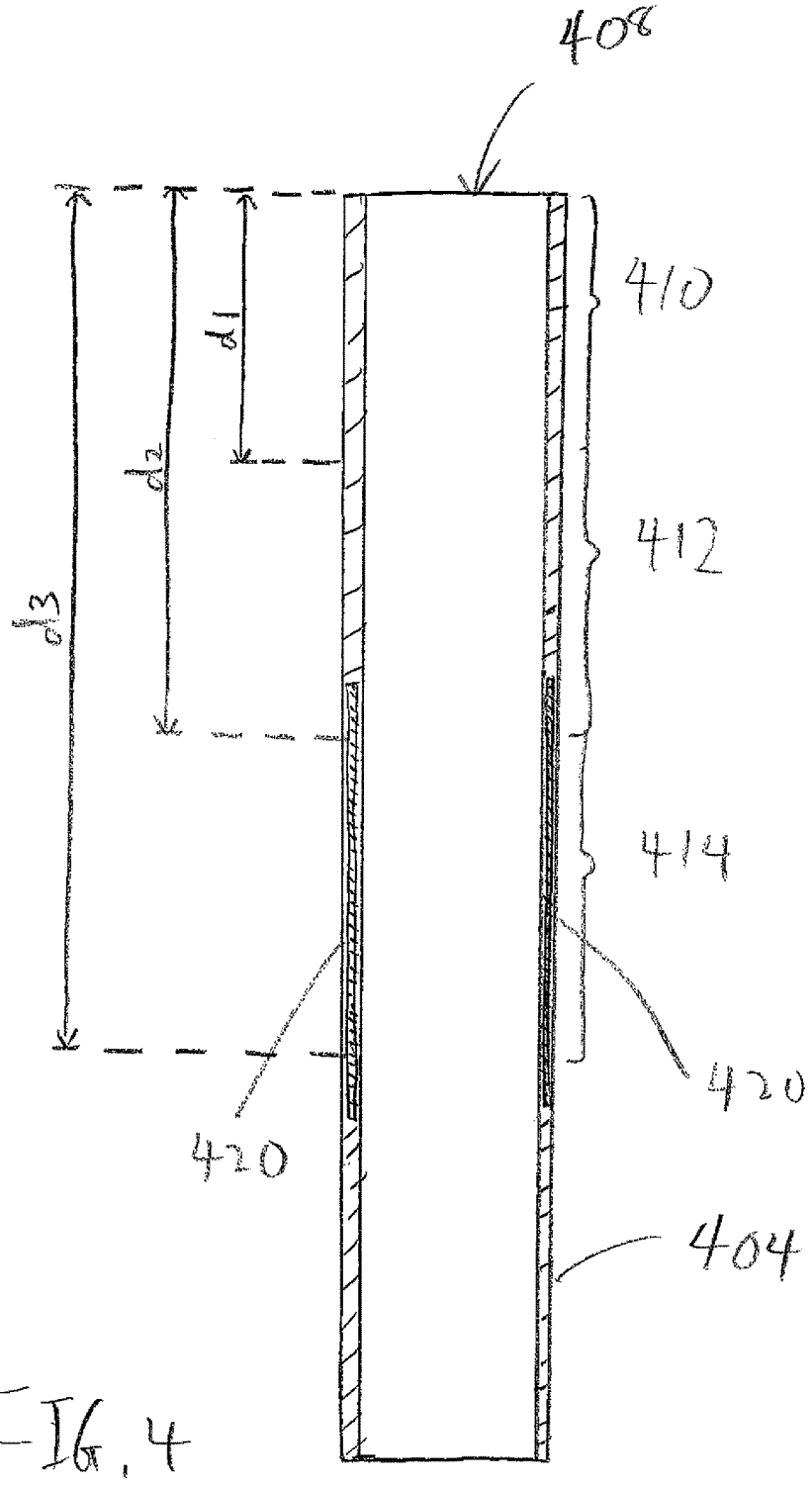
FIG. 4 shows an enlarged cross-sectional view of the butt end or proximal end of the golf club shaft in accordance with a further alternative embodiment of the present invention.

FIG. 4 of the accompanying drawings shows a cross-sectional view of the butt end 408 or proximal end of a shaft 404 in accordance with an alternative embodiment of the present invention. In this embodiment of the present invention, the dense layer 420 may extend slightly into periphery regions of the shaft 404 beyond the boundaries of the heavy weighted section 414. Despite the slight variation in the weighting element shown here, the criticality of the present invention remains in preserving the mass of the heavy weighted section 414. Hence, despite the slight variation in the location and size of the dense layer 420, the overall mass of the heavy weighted section 414 may still be greater than about 9 grams, more preferably greater than about 9.5 grams, and most preferably greater than about 10 grams.

Figure 5:
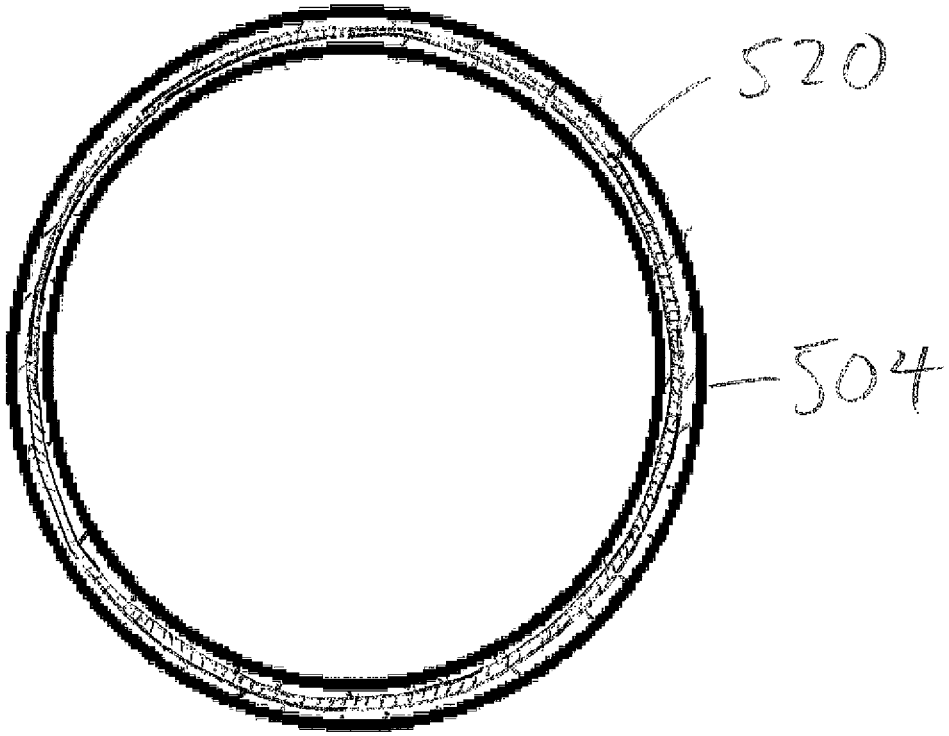
FIG. 5 shows a cross-sectional view of a golf club shaft in accordance with an exemplary embodiment of the present invention, taken from a plane that is perpendicular to the shaft.

Although the cross-sectional view of the golf club shaft 202, 302, and 402 shows the profile of the heavy weighted section 214, 314, and 414 along the length of the golf club shaft 202, 302, and 402, it does not paint a complete picture of how the current invention works. To do that, FIG. 5 is provided with another cross-sectional view of the golf club shaft 500 in accordance with an exemplary embodiment of the present invention taken perpendicular to the shaft 504 itself. Based on this cross-sectional view of the shaft 504, it can be seen that the dense layer 520 may be located centrally between the internal wall and the external wall of the shaft 504. However, as previously mentioned, the location of the dense layer 520 could be placed closer to the internal wall or the external wall all without departing from the scope and content of the present invention as long as it can achieve the weighting requirements mentioned above.

Figure 6:
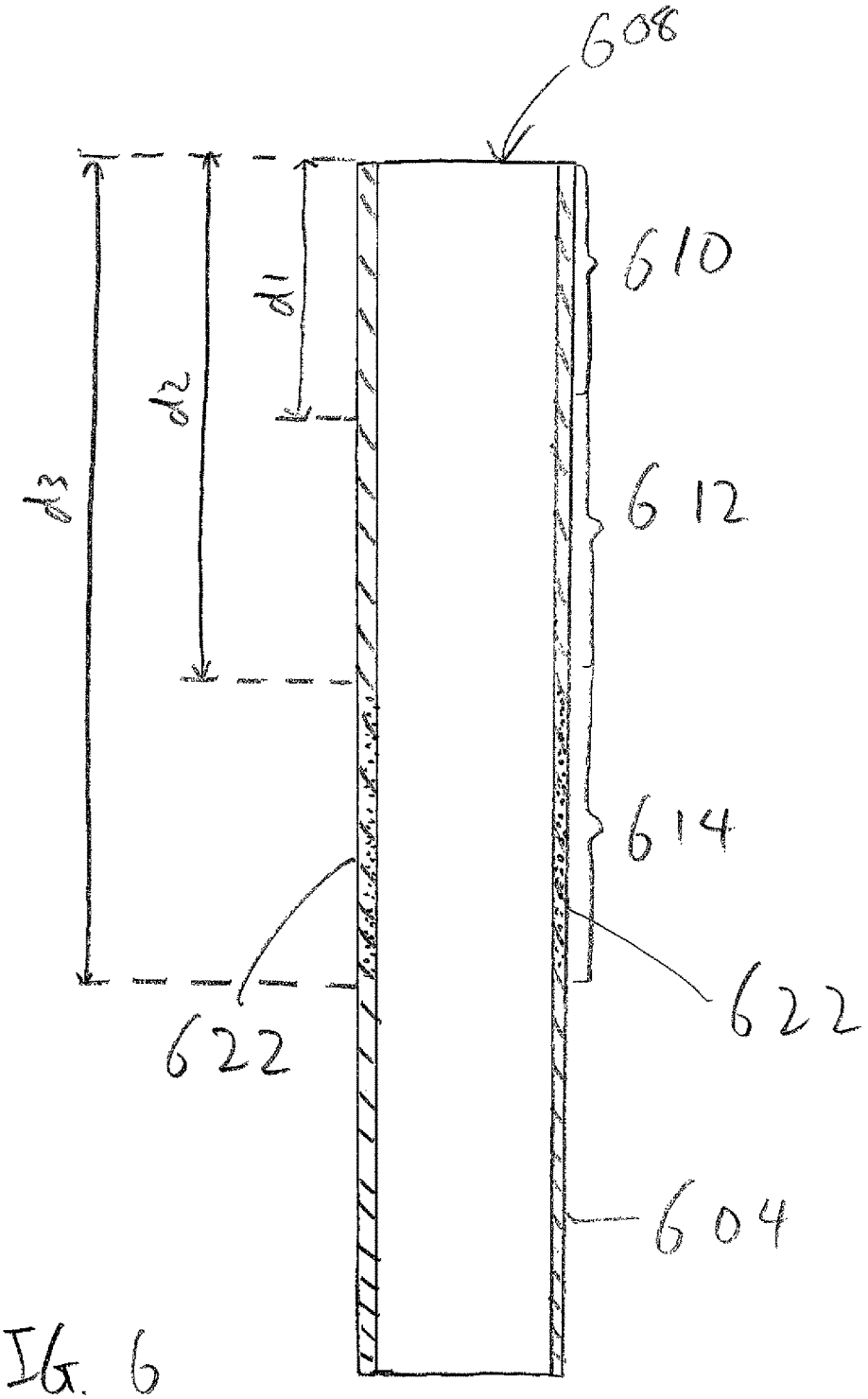
FIG. 6 shows an enlarged cross-sectional view of the butt end or proximal end of the golf club shaft in accordance with a further alternative embodiment of the present invention.

FIG. 6 of the accompanying drawings shows a cross-sectional view of the butt end 608 or proximal end of the shaft 604 in accordance with an alternative embodiment of the present invention. In this embodiment of the present invention the dense layer 220, 320, and 420 shown in previous embodiments (See FIG. 2, FIG. 3, and FIG. 4) has been removed. In its place, the present invention utilizes a dense powder 622, scattered within the heavy weighted section 614 to achieve the desired weighting without departing from the scope and content of the present invention. Using a dense powder may be preferred in certain situations wherein a more uniform shaft is desired. Due to the fact that a golf club shaft 604 may constantly be subjected to high levels of stress during a golf swing, the ability to minimize incidental effects to the stiffness and flex of the golf club shaft 604 may often be desirable. Dense powder 622, as shown in this exemplary embodiment may also be made out of tungsten for its high density characteristics, however numerous other materials could be used to create the dense powder 622 without departing from the scope and content of the present invention so long as it is capable of creating the weighting profile indicated above.

Figure 7:
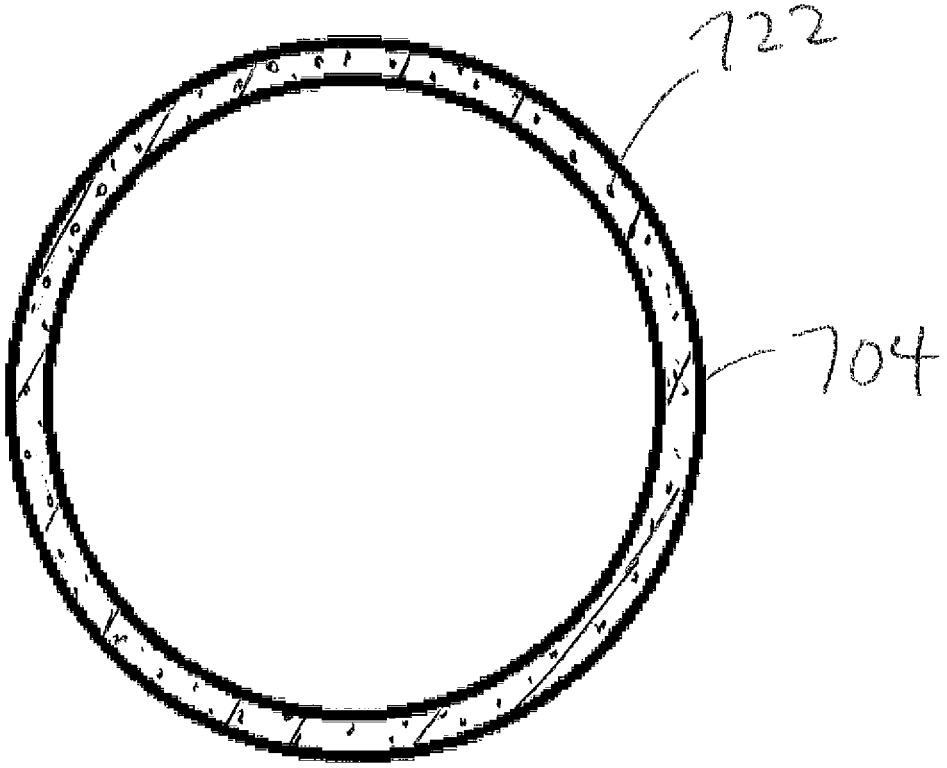
FIG. 7 shows a cross-sectional view of a golf club shaft in accordance with an exemplary embodiment of the present invention, taken from a plane that is perpendicular to the shaft.

Finally, FIG. 7 of the accompanying drawings shows a cross-sectional view of the golf club shaft 700 in accordance with an exemplary embodiment of the present invention taken perpendicular to the shaft 704 itself. Although this embodiment of the golf club shaft 704 may utilize a dense powder 722 that is evenly scattered throughout the resin of the carbon fiber, the dense powder 722 could also be biased towards a specific layer of composite that is biased towards the internal wall or the external wall, all without departing from the scope and content of the present invention.

It is worth nothing that although the proceeding discussion regarding golf club shafts have been focused on carbon fiber shafts, the same technology could be applied towards steel shafts as well without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

Any definitions, terminology, or characterizations of the invention included herein shall take precedence over any conflicting information provided in any material incorporated by reference.

What is claimed is:

1. A golf club comprising:

a club head located at a distal end of said golf club;

a grip located at a proximal end of said golf club; and a shaft juxtaposed between said club head and said grip, connecting said club head to said grip;

wherein said shaft further comprises a heavy weighted section, located at a distance of between exactly 10 and exactly 15 inches away from said proximal end of said golf club, wherein said heavy weighted section has a mass of greater than about 9 grams, wherein said heavy weighted section further comprises a dense layer, said dense layer is centrally located between an internal wall of said shaft and an external wall of said shaft, and wherein said dense layer is created using a dense powder.

2. The golf club of claim 1, wherein said heavy weighted section has a mass of greater than about 9.5 grams.

3. The golf club of claim 2, wherein said heavy weighted section has a mass of greater than about 10 grams.

4. The golf club of claim 1, wherein said shaft further comprises a second lightweight section, located at a distance of between 5 and 10 inches away from said proximal end of said golf club;

wherein a mass of said heavy weighted section is greater than about 14% of a mass of said shaft.

5. The golf club of claim 4, wherein said mass of said heavy weighted section is greater than about 15% of the mass of said shaft.

6. The golf club of claim 5, wherein said mass of said heavy weighted section is greater than about 17% of the mass of said shaft.

7. The golf club of claim 1, wherein a mass of said heavy weighted section is greater than about 14% of a mass of said shaft.

8. The golf club of claim 7, wherein said mass of said heavy weighted section is greater than about 15% of said mass of said shaft.

9. The golf club of claim 8, wherein said mass of said heavy weighted section is greater than about 17% of said mass of said shaft.

10. The golf club of claim 1, wherein said heavy weighted section further comprises a dense layer, wherein said dense layer is biased towards an internal wall of said shaft.

11. The golf club of claim 1, wherein said heavy weighted section further comprises a dense layer, wherein said dense layer is biased towards an external wall of said shaft.

* * * * *